US005172754A

United States Patent [19]

Graber et al.

[11] Patent Number: 5,172,754

[45] Date of Patent: Dec. 22, 1992

[54] HEAT EXCHANGER FOR RECOVERY OF HEAT FROM A SPA OR HOT TUB PUMP MOTOR

[76] Inventors: Neil M. Graber, 4125 E. Independence, Charlotte, N.C. 28205; Carol R. Puryear, 6527 Creekstone Pl., Charlotte, N.C. 28213

[21] Appl. No.: 643,139

[22] Filed: Jan. 17, 1991

Related U.S. Application Data

[63] Continuation-in-part of Ser. No. 263,373, Oct. 27, 1988, abandoned.

[51] Int. Cl.[5] ..... F28F 7/00; H02K 9/00; H02K 9/02; F04B 17/00

[52] U.S. Cl. ..... 165/47; 165/168; 165/169; 417/366; 417/370; 417/423.12; 417/423.8; 4/545; 4/541.2; 310/54; 310/64

[58] Field of Search ..... 165/47, 168, 169; 310/54, 64; 290/2; 417/423.12, 366, 370, 423.8; 4/542, 545, 544

[56] References Cited

U.S. PATENT DOCUMENTS

| | | | |
|---|---|---|---|
| 1,830,457 | 11/1931 | Apple | 310/54 |
| 2,784,672 | 3/1957 | Wallace | 310/54 |
| 2,887,062 | 5/1959 | Cametti et al. | 310/54 |
| 2,913,988 | 11/1959 | White | 310/54 |
| 3,071,075 | 1/1963 | Spring | 417/423.12 |
| 3,127,530 | 3/1964 | White | 310/54 |
| 3,163,790 | 12/1964 | White | 310/54 |
| 3,450,056 | 6/1969 | Heathcote et al. | 417/423.12 |
| 3,681,609 | 8/1972 | Boese et al. | 290/2 |
| 3,841,791 | 10/1974 | Doolin | 417/423.12 |
| 3,870,942 | 3/1975 | Boese et al. | 310/54 |
| 4,516,915 | 5/1985 | Jensen et al. | 417/423.12 |
| 4,850,818 | 7/1989 | Kotera | 417/366 |
| 4,854,373 | 8/1989 | Williams | 165/47 |
| 4,858,254 | 8/1989 | Popovich et al. | 4/542 |

FOREIGN PATENT DOCUMENTS

| | | | |
|---|---|---|---|
| 2449262 | 10/1980 | France | 165/40 |

*Primary Examiner*—John Ford

[57] ABSTRACT

A heat exchanger coil for heating water in a spa or hot tub by transferring heat generated by an electric motor driving a pump to the water in the coil while the pump circulates the water through the spa or hot tub. A restrictor mounted on the shaft of the electric motor creates additional friction between its outer surface and the inner surface of the motor seal to further warm the water.

9 Claims, 6 Drawing Sheets

HEAT EXCHANGER FOR RECOVERY OF HEAT FROM A SPA OR HOT TUB PUMP MOTOR

This application is a C.I.P. of 07/263,373, filed Oct. 27, 1988, now abandoned.

FIELD OF THE INVENTION

This invention relates to the heating of water by the transfer of heat generated by the electric motor of a water pump, with heating coils surrounding said motor, as the water is recirculated through a closed system such as a spa or the like.

BACKGROUND OF THE INVENTION

Water is generally heated for a spa or the like by a gas fired or electric heating unit and recirculated through the heating unit and the tub of the spa by an electric pump. In most instances the heating unit is separate from the pump, as in Pat. No. 3,630,175 issued Dec. 28, 1981 to Reid, Jr., et at. for FLUID HEATER.

Pat. No. 4,594,500 issued Jun. 10, 1986 to Wright for ELECTRICALLY HEATED PUMP FOR SPAS AND SWIMMING POOLS combines an electric heating unit with a pump as a way to overcome the cost of having separate appliances. Wright combines the heater with the pump, but he still has the cost of installing and the expense of operating a separate heater for the water.

SUMMARY OF THE INVENTION

An object of the present invention is to eliminate the need and cost of a separate appliance for heating water as it is circulated through a closed system by transferring heat from an electric motor, by means of heating coils surrounding the motor, to the water while the pump circulates the water through the system.

A more efficient and economical system is thereby provided to heat and operate a closed system, such as a spa or the like. Aside from the initial cost, use of a prior art heating unit and separate pump costs about $30.00 per month to operate, whereas it costs about $8.00 to circulate and heat the same amount of water using only a motor driven pump as the heat source.

DETAILED DESCRIPTION OF THE INVENTION

The Pump

Figure 1:
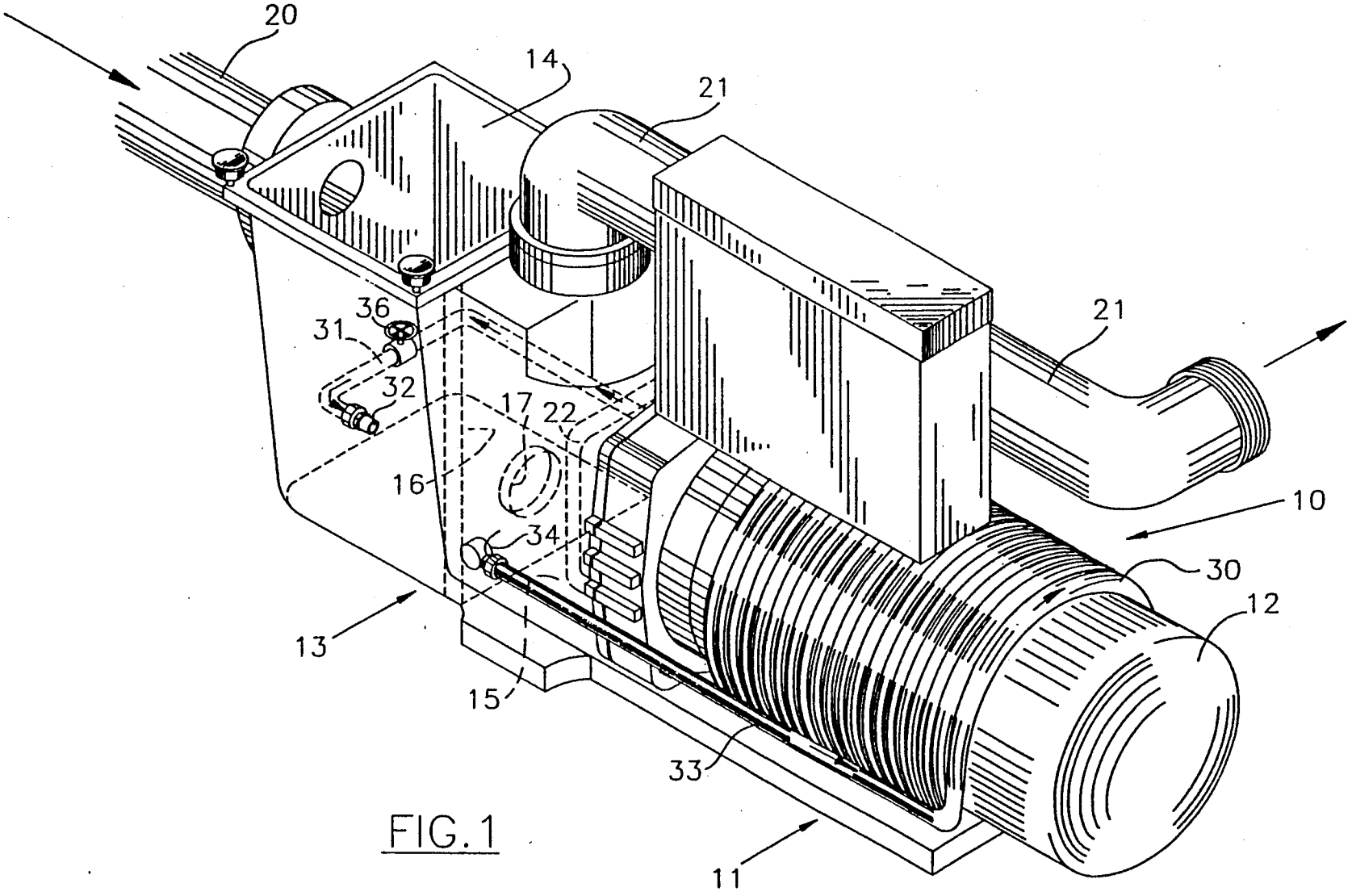
FIG. 1 is a perspective view of the motor driven pump, illustrating a heating coil wound around the motor, thermal insulation for the coil being omitted for the purpose of clarity, and illustrating the inlet and outlet chambers at the wet end of the pump.

Referring more specifically to the drawings, the numeral 10 broadly indicates a water pump with an electric motor of the type commonly used for the circulation of water through a closed system, such as a spa or the like. Although the invention is useful to heat water being recirculated through any closed system by an electrically operable water pump, the invention will be described in the enviroment of a spa for the sake of convenience.

The pump 10 has a dry end broadly indicated at 11 and comprising a base supporting the electric motor 12 which, in the illustrated embodiment, is rated at $\frac{3}{4} \times 1/5$ horsepower, however any size 2-speed 48 or 56 frame motor will acheive the desired results. The pump 10 also has a wet end broadly indicated at 13, including an inlet chamber (low pressure side) 14 and an outlet chamber (high pressure side 15 separated by a wall 16 having an opening 17 which provides communication between the two chambers.

A return pipe 20 provides communication between the inlet (suction) chamber 14 and a spa 37. A supply pipe 21 provides communication between the outlet (discharge) 15 and the spa 37. Water moves through the inlet and outlet chambers and between the pump and the spa under the force of an impeller 22 mounted for rotation with the armature shaft 23 of the electric motor 12.

The pump circulates water to and from the spa through rotation of the armature shaft the impeller 22. The impeller 22 moves the water out of the outlet chamber 15 through the supply pipe 21 to the spa while sucking water from the spa through return pipe 20 into the inlet, chamber 14 and through the opening 17 in the wall 16 to the outlet chamber 15. Operation of the pump causes the motor to generate heat as the armature rotates. After several hours operation the motor sometimes generates so much heat that its housing becomes hot enough to burn a person's hand.

The foregoing structure is conventional. It is also known to journal the armature shaft 23 of the electric motor with a seal broadly indicated at 24, for the purpose of truing and balancing the rotation of the armature. The seal 24 comprises a ceramic sleeve 25 that encircles the armature shaft to seal it and is joined to an outer ring 26 formed from neoprene or the like that is pressed tightly against the inner wall of the motor housing to prevent leakage.

Figure 6:
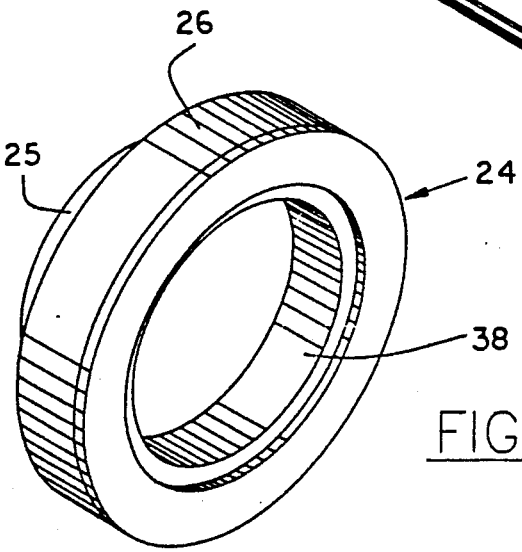
FIG. 6 is a perspective view of a motor seal and restrictor removed from the pump.
Figure 5:
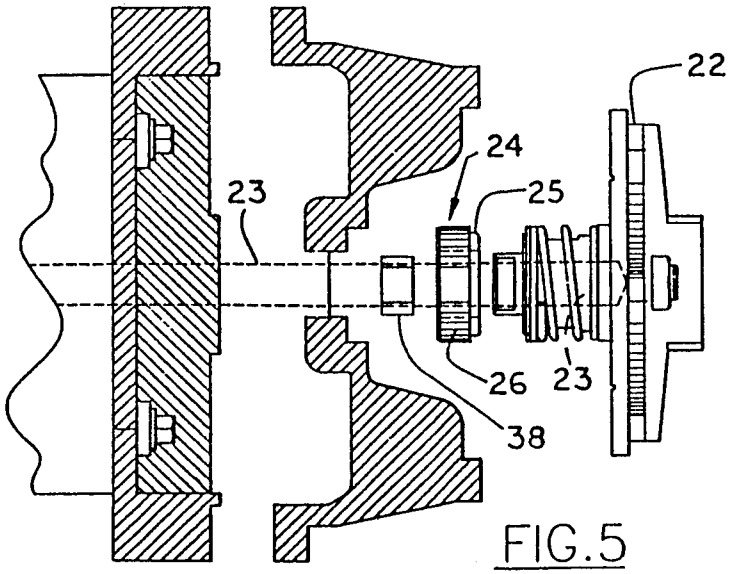
FIG. 5 is an exploded sectional view, with parts broken away, taken substantially along the line 5—5 in FIG. 2.
Figure 7:
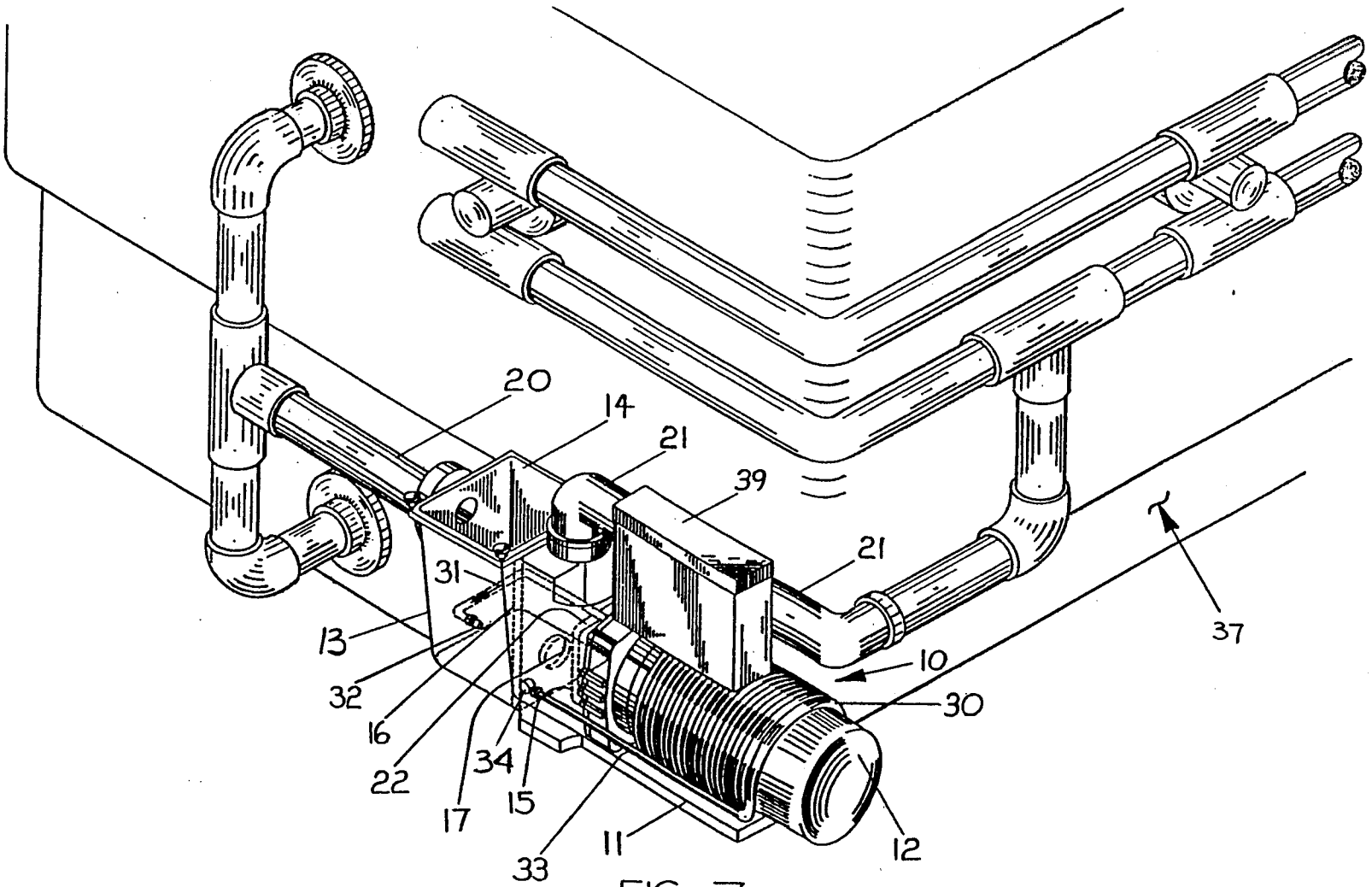
FIG. 7 is a perspective view of the pump driven motor with the heating coil wound around the motor, the control box mounted to the unit, and the suction and return lines as they attach to a typical spa installation.

According to one aspect of the invention the heat generated by the motor is augmented by the use of a restrictor 38 (FIGS. 5 and 6). The restrictor 38 (FIGS. 5 and 6) is installed between the seal and the armature shaft of the motor. The restrictor is installed while the motor is disassembled. At that time the restrictor is inserted between the seal and the armature shaft. The restrictor can be manufactured out of several kinds of material, ceramic and neoprene are just a few and the most commonly used ones. The motor is then reassembled and the heating coils are placed around the motor.

The restrictor 38, separate from the motor seal 24, is mounted on the armature shaft 23 to rotate therewith and is sized (as shown in FIG. 6) so as to create additional friction between the restrictor outer surface and the inner surface of the motor seal thereby further heating the water circulating through the pump.

The Heat Exchanger

Applicants have found that heat from the motor can be effectively harnessed and used to heat the water as it is recirculated by the pump.

Figure 4:
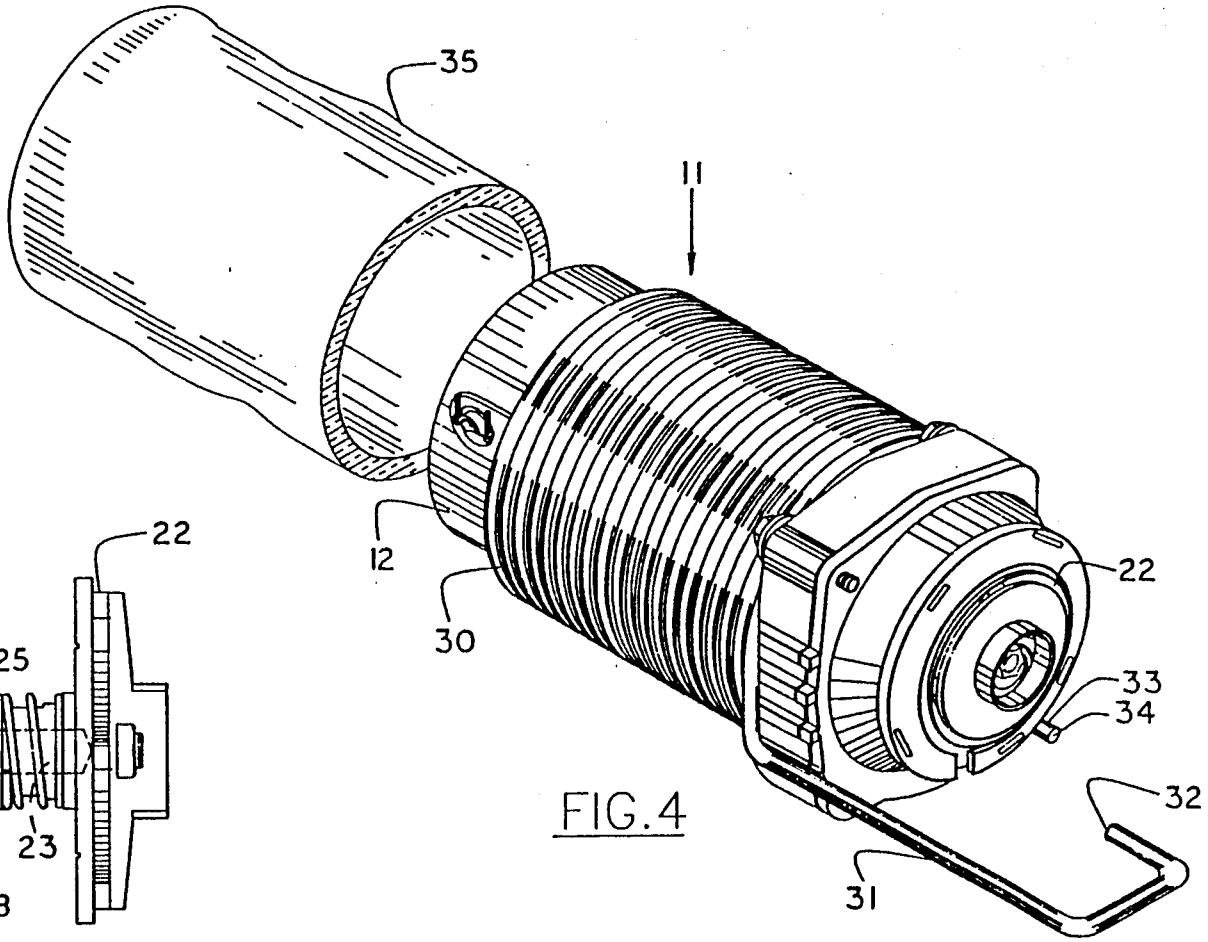
FIG. 4 is an exploded Perspective view of the electric motor shown in FIG. 2 with the heating coil of FIG. 3 operatively wrapped around the motor, and showing thermal insulation which covers the heating coil in use.

In the illustrated embodiment, heating coil 30 is formed from about thirty-six feet of stainless steel tubing with a diameter of approximately ⅜ of an inch. Other materials are available for use as the heat exchange coil material, copper, brass, etc., but stainless steel is found to have superior corrosion resistance to the chemicals found in everyday use associated with a spa. The steel tubing is wrapped tightly around the housing of the pump motor 12 and in the illustrated embodiment the twenty convolutions, more or less, of tubing are in snug engagement with each other and with the motor housing as shown in FIGS. 1 and 4.

Water from the spa enters the heating coil 30 through a supply line 33 formed integral with and communicating with the front end of the coil 30 remote from the wet end 13 of the pump. An inlet 34 at the front end of the supply line 33 communicates with the interior of the inlet chamber 15 in the wet end 13 of the pump 10.

A return line 31 is formed integral with and communicates with the rear end of the coil 30 nearest from the wet end 13 of the pump 10. An outlet 32 at the front end of the return line 31 communicates with the interior of the outlet chamber 14.

Operation of the Heat Exchanger

Over a period of time (approximately twenty four hours) the heating coil effectively heats the spa water from any starting temperature to a desired temperature, such as 104° F., without any alteration of the normal operation of the pump. A restrictor 38 is applied on the armature shaft to achieve optimum heating capabilities. Thermal insulation 35 covers the heating coil 30 to confine the heat and effect maximum transfer of the motor heat to the water in the heating coil.

Water returning from the spa through the return pipe 20 moves throughout the inlet chamber 14 with turbulence before passing through the opening 17 in the wall 16 to the outlet chamber 15. The inlet 34 of the supply line 33 for the heating coil 30 is strategically located at the high pressure discharge chamber 15 and the water returning from the spa moves into the supply line 34 and through the heating coil 30 and is exposed to the heat of the motor before the heated water is delivered through the return line 31 and outlet 32 to the low pressure inlet chamber.

The freshly heated water from the outlet 32 of the heating coil 30 mixes with and warms the cooler water returning from the spa to the inlet chamber 14 before the impeller returns the warmed water to the spa through the return pipe 21.

Figure 2:
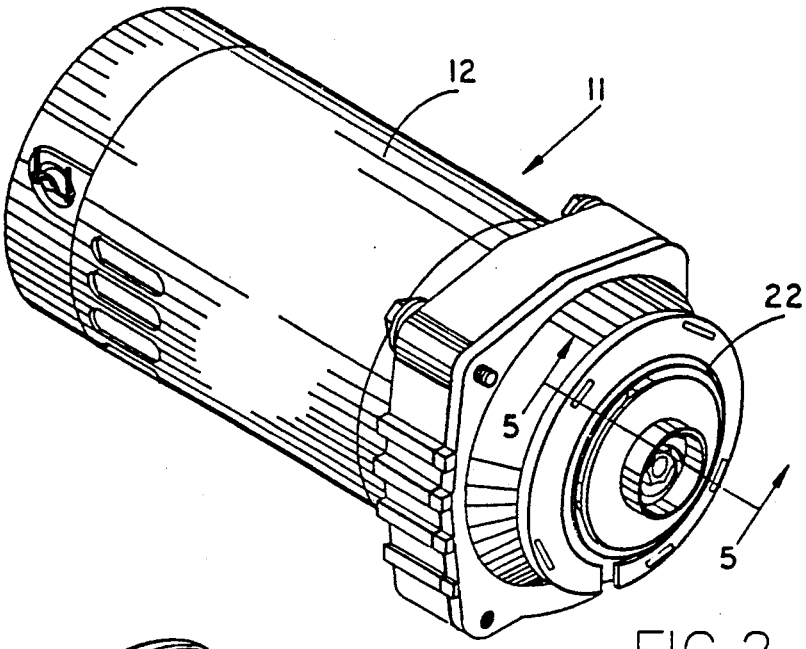
FIG. 2 is a perspective view of the electric motor, omitting the heating coil and looking at the side opposite that shown in FIG. 1.
Figure 3:
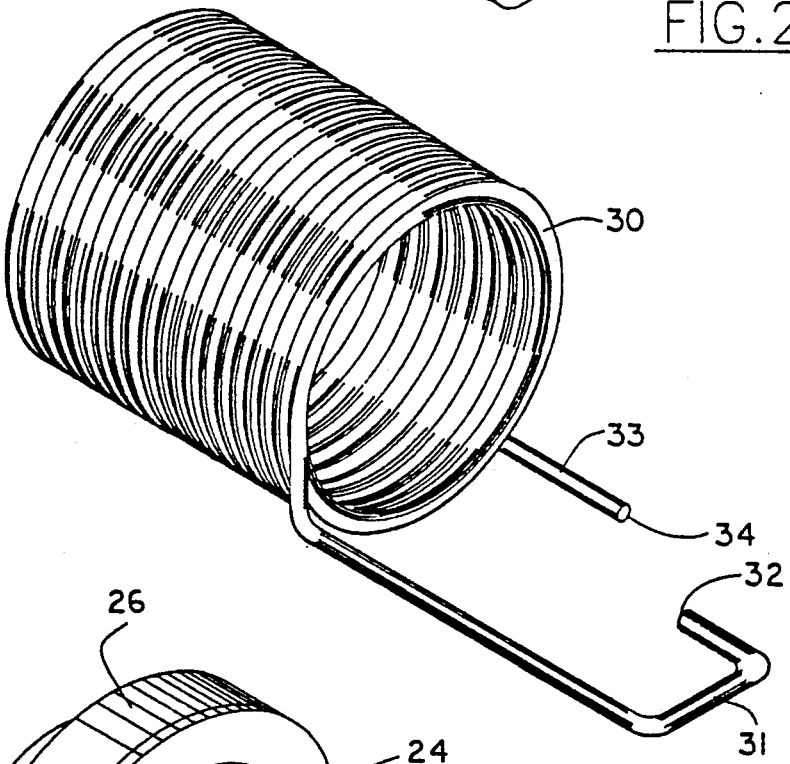
FIG. 3 is a perspective view of the heating coil removed from the motor and looking at the side opposite that shown in FIG. 1.

To further facilitate the invention and in conjunction with the operation of the motor, an electrical control box 39, of hard plastic or metal, is attached to the motor using motor bolts 40 shown in FIG. 2. This control box houses the electrical components that allow the motor driven pump to work effectively and safely.

Figure 8:
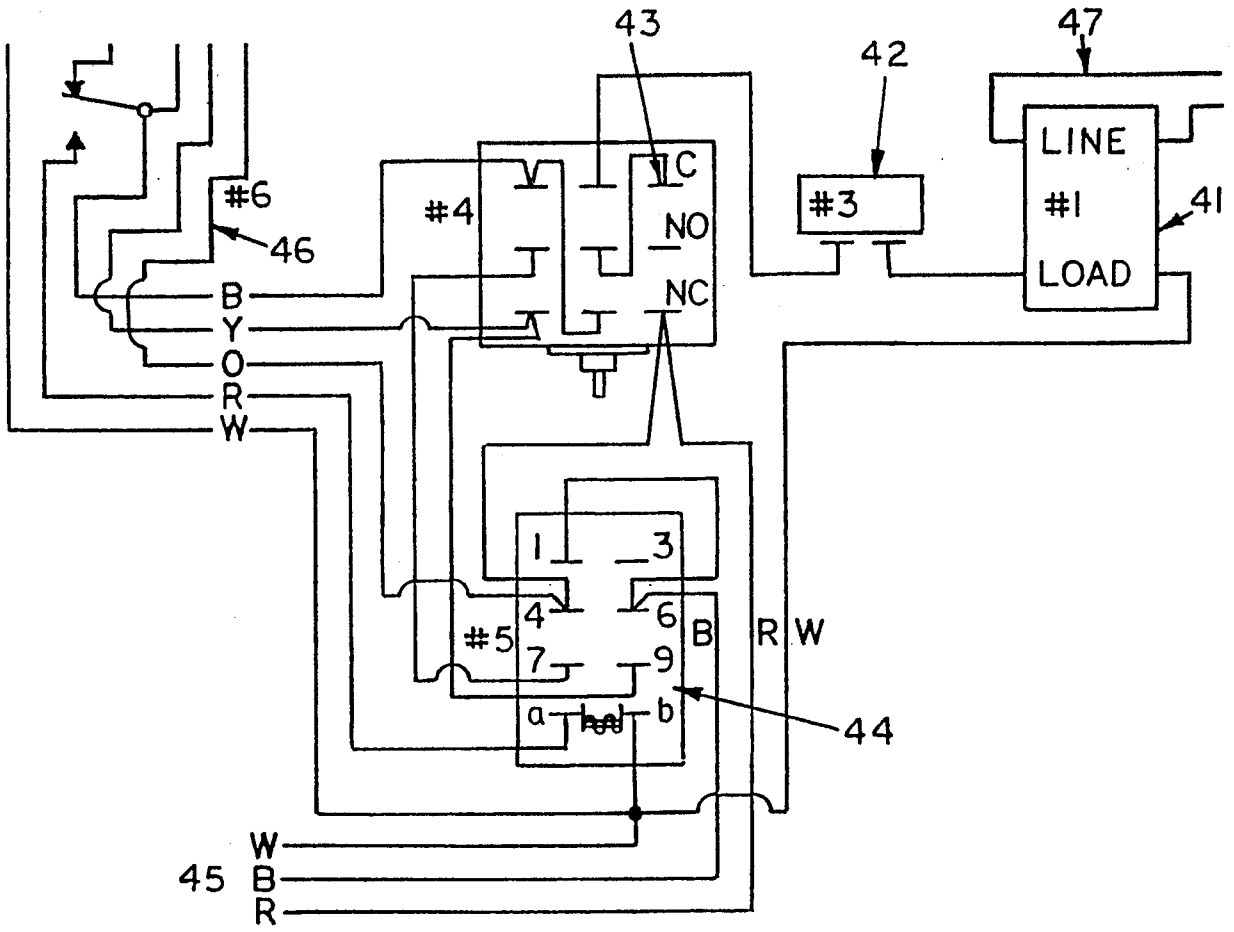
FIG. 8 is a schematic of the deluxe electric mechanical wiring of the present invention.
Figure 9:
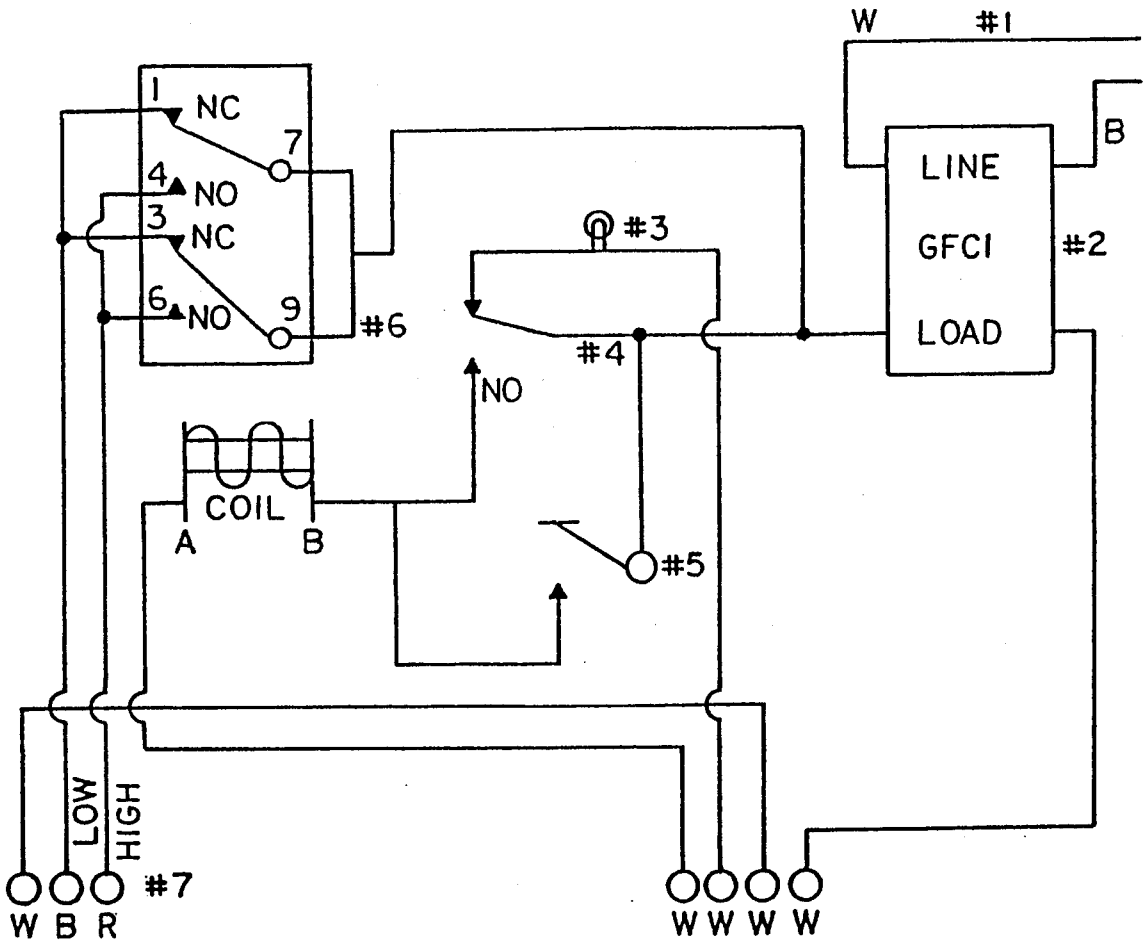
FIG. 9 is a schematic of the simplistic electric mechanical wiring of the present invention.

The main supply line 47 shown in FIG. 8 brings energy from a plug inserted into a 120 v household outlet receptacle, this electrical supply then connects into switches (including GFCI Breaker 47, pump relay switch 44, 2-speed motor 45 and a thermostat command center 46) all wired in series. Once the body of water reaches the desired temperature, the pump motor will shut down from high speed to low speed to maintain water temperature or shut completely off, depending on the function the command center is in. A high limit switch is controlled by a thermostat sensor mounted in return line 20, whereby should the water get to hot the unit will shut itself down completely. There are several wiring schematics that can be utilized depending on the requirements for different applications. FIGS. 8 & 9 show a sophisticated and a very simplistic wiring schematic respectively.

There is thus provided an efficient heat exchanger which captures and transfers the operational heat from the pump motor to the spa water without any structural or functional change of the pump and without any need for a separate accessory to heat the water, thereby resulting in substantial savings without any loss in efficiency or comfort.

Although specific terms have been used in describing the invention, they have been used in a generic sense only and not for the purpose of limitation. Any changes made to the disclosed invention are within the spirit of the invention if they are within the scope of the appended claims.

We claim:

1. An apparatus for recovery of waste heat from an electric motor driven pump having a wet end for recirculating water through a spa or hot tub comprising:

a coil of tubing contacting the exterior surface of said motor and having opposite respective ends thereof connected to a discharge and a suction side of said pump;

a motor seal sealing an armature shaft of said motor from pump fluid leakage and an annular restrictor separate from said motor seal being mounted to rotate with said motor shaft and sized to create additional friction between the outer surface of said restrictor and the inner surface of said motor seal thereby further heating the water recirculating between the spa or hot tub and the pump.

2. The apparatus according to claim 1 wherein the pump has an inlet and an outlet chamber respectively forming said suction and discharge sides of said pump and only a portion of the water discharged by the pump is circulated through said coil.

3. The apparatus according to claim 2 wherein the inlet to said coil is connected to the discharge side of said pump and the outlet of said coil is connected to the suction side of said pump and said coil inlet and outlet are at approximately the same level.

4. The apparatus according to claim 3 wherein said coil is covered with insulation to concentrate the heating effect in relationship to the water circulating in said coil.

5. The apparatus according to claim 1 wherein said electric motor is a 48 frame motor.

6. The apparatus according to claim 1 wherein said electric motor is a 56 frame motor.

7. The apparatus according to claim 1 wherein said electric motor has two speeds.

8. The apparatus according to claim 7 wherein said two speed motor has thermostatic means for operating the motor at low and high speeds.

9. The apparatus according to claim 1 wherein said coil consists of the sole source of external heating for said spa or hot tub.

* * * * *